US008226196B2

(12) United States Patent
Kim

(10) Patent No.: US 8,226,196 B2
(45) Date of Patent: Jul. 24, 2012

(54) IMAGE FORMING APPARATUS, IMAGE FORMING METHOD AND COMPUTER READABLE MEDIUM RECORDED WITH A PROGRAM EXECUTING THE IMAGE FORMING METHOD

(75) Inventor: Hyoung-il Kim, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 664 days.

(21) Appl. No.: 11/942,967

(22) Filed: Nov. 20, 2007

(65) Prior Publication Data

US 2008/0266347 A1 Oct. 30, 2008

(30) Foreign Application Priority Data

Apr. 24, 2007 (KR) ..... 10-2007-0039980

(51) Int. Cl.
*B41J 29/38* (2006.01)

(52) U.S. Cl. ..... 347/16; 347/19; 347/9

(58) Field of Classification Search ..... 347/5, 9, 347/16, 171, 19; 400/625, 708
See application file for complete search history.

(56) References Cited

U.S. PATENT DOCUMENTS

| | | | | |
|---|---|---|---|---|
| 5,564,848 | A * | 10/1996 | Quintana | 400/708 |
| 6,565,171 | B2 * | 5/2003 | Miquel et al. | 347/5 |
| 2004/0179053 | A1 * | 9/2004 | Itoh | 347/16 |
| 2005/0140770 | A1 * | 6/2005 | Kang et al. | 347/198 |
| 2005/0214055 | A1 * | 9/2005 | Ejiri et al. | 400/625 |

FOREIGN PATENT DOCUMENTS

| | | |
|---|---|---|
| JP | 2003-11345 | 1/2003 |
| JP | 2003-79189 | 3/2003 |
| JP | 2005-59969 | 3/2005 |

* cited by examiner

*Primary Examiner* — Lam S Nguyen
(74) *Attorney, Agent, or Firm* — Stanzione & Kim, LLP

(57) ABSTRACT

An image forming apparatus includes a medium transferring unit which transfers a printing medium to a predetermined target position and a controller which controls the medium transferring unit in a predetermined external disturbance prevention mode to transfer the printing medium a predetermined amount by transferring the printing medium past the target position first in a forward direction past the target position, then in a backwards direction past the target position and then to the target position in the forward direction.

18 Claims, 15 Drawing Sheets

PRINTING MEDIUM DESIRED SPEED (inch/sec)
0.4
0.3
0.2
0.1
0
-0.1
-0.2
TIME

PRINTING MEDIUM ACUTAL SPEED (inch/sec)
0.4
0.3
0.2
0.1
0
-0.1
-0.2
TIME

POSITION ERROR (mm)
0.2
0
-0.2
-0.4
e(n-1)
e(n)
TIME
T11
T12
T13
T14
M
N
Q
PRINTING OPERATION
PRINTING OPERATION
TARGET POSITION
x(n-1)
x(n)
x(n)
x(n+1)

IMAGE FORMING APPARATUS, IMAGE FORMING METHOD AND COMPUTER READABLE MEDIUM RECORDED WITH A PROGRAM EXECUTING THE IMAGE FORMING METHOD

CROSS-REFERENCE TO RELATED APPLICATIONS

This application claims priority from Korean Patent Application No. 10-2007-0039980, filed on Apr. 24, 2007 in the Korean Intellectual Property Office, the disclosure of which is incorporated herein in its entirety by reference.

BACKGROUND OF THE INVENTION

1. Field of the Invention

The present general inventive concept relates to an image forming apparatus and method thereof, and more particularly, to an image forming apparatus having an improved printing medium transferring method.

2. Description of the Related Art

In general, an image forming apparatus forms predetermined image information on a printing medium. The image forming apparatus may be an ink jet printer, or an electrophotographic laser printer for example.

The ink jet printer jets a tiny droplet of ink for printing ink onto a desired position on a printing medium to print an image. The ink jet printer may have a shuttle-type head in which a head moves right and left along a transverse direction of a transferring direction of the printing medium to print one line, or an array-type head in which nozzles are arranged along a width of the printing medium to print one line at a time.

The shuttle-type head ink jet printer generally has a desired speed profile graph of a printing medium according to time as illustrated in FIG. 1. That is, after the printing medium is unit-transferred during time T1 to T2 a predetermined amount in the transferring direction of the printing medium, the movement of the printing medium is paused during time T2 to T3. The head moves along the transverse direction to print one line during time T2 to T3. After printing one line, the printing medium is unit-transferred a predetermined amount, and another line is printed during time T4 to T5. The entire image of printed ink is formed by repeating this process. The term "unit-transfer" as used in this disclosure refers to an operation intended to achieve a transfer of a unit amount, such as an amount corresponding to a desired spacing between adjacent lines of printing of an image.

The ink jet printer may include a medium transferring unit to transfer the printing medium to the head in accordance with the desired speed profile in FIG. 1. The medium transferring unit may include a feeding roller and an idle roller pair to hold a leading edge part of the printing medium to transfer the printing medium to the head, and a driving roller and a driven roller pair to hold a trailing edge part of the printing medium to transfer the printing medium to the feeding roller/idle roller pair.

FIG. 2A is a graph illustrating a desired speed of a printing medium at a proximate point where the trailing edge part of the printing medium is separated from the driving roller/driven roller pair, and FIGS. 2B and 2C are graphs illustrating an actual speed and a position error of the printing medium, respectively. Here, a positive speed corresponds to a forward transferring direction and a negative speed corresponds to a backward direction or a direction opposite of the forward transferring direction. The maximum value of a position error value illustrated in FIG. 2C is approximately 0.45 mm, indicating that the printing is performed through unit-transferring the printing medium at an interval of 0.45 mm.

As illustrated in FIG. 2C, the position error can be seen as zero after the printing medium is unit-transferred during time T1 to T2 by an interval of 0.45 mm. As the head moves in the transverse direction during time T2 to T3, one line of image is printed. After this one line of image is printed, the printing medium is unit-transferred during time T3 to T4 and the head again moves during time T4 to T5 to print another line.

However, as illustrated in FIG. 2B, a sudden external disturbance is received by the ink jet printer during the printing at time T4 to T5. Although the printing medium is in the paused state and it is desired not to move the printing medium, the external disturbance generate a position error on the printing medium.

In particular, since the external disturbance arises during the printing process, there is no opportunity to compensate for the position error, and also the ink image line is formed in undesired position, thereby deteriorating image quality.

SUMMARY OF THE INVENTION

The present general inventive concept provides an image forming apparatus, an image forming method and a computer readable medium recorded with a program to execute the image forming method to precisely transfer a printing medium to improve image quality.

The general inventive concept also provides an image forming apparatus, an image forming method and a computer readable medium recorded with a program to execute the image forming method capable of preventing an effect of an external disturbance.

The general inventive concept also provides an image forming apparatus, an image forming method and a computer readable medium recorded with a program to execute the image forming method to improve image quality.

Additional aspects and utilities of the present general inventive concept will be set forth in part in the description which follows and, in part, will be obvious from the description, or may be learned by practice of the present general inventive concept.

The foregoing and/or other aspects and utilities of the present general inventive concept may be achieved by providing an image forming apparatus, including a medium transferring unit to transfer a printing medium to a predetermined target position, and a controller to control the medium transferring unit to transfer the printing medium first past the target position and then second to the target position.

The medium transferring unit may unit-transfer the printing medium intermittently by one step unit to a plurality of the target positions.

The image forming apparatus may further include an image forming unit which forms an image on the printing medium, wherein the controller controls the image forming unit to form an image on the transferred printing medium.

The medium transferring unit may include a leading edge holding unit to hold a leading edge part of the printing medium, and a trailing edge holding unit to hold a trailing edge part of the printing medium and to release a held state of the printing medium if the printing medium reaches a predetermined release position, wherein the controller determines to apply the external disturbance prevention mode if the printing medium passes the release position.

The release of the held state of the trailing edge holding unit may be accomplished by a forward transfer of the printing medium.

The trailing edge holding unit may include a pair of rollers which are provided to rotate for transferring the printing medium in a forward direction.

The image forming apparatus further may include an encoder to sense a rotation number of one of the leading edge holding unit and the trailing edge holding unit, wherein the controller determines on the basis of the sensed rotation number whether the printing medium passes the release position.

The foregoing and/or other aspects of the present general inventive concept may also be achieved by providing an image forming method of an image forming apparatus including transferring the printing medium in a forward direction past a target position; transferring the printing medium in a backward direction to the target position; and positioning the printing medium at the target position.

The method may further include jetting ink with a printing head of the image forming unit, and moving the printing head on a carriage in a transverse direction.

The image forming method may further include forming the image on the printing medium at the target position.

The image forming method may further include transferring the printing medium in the forward direction with respect to a next target position which is separated from the target position to the forward direction by a predetermined width; transferring the printing medium in the backward direction with respect to the next target position; and positioning the printing medium at the next target position.

The image forming method may further include determining whether to apply an external disturbance prevention mode.

The medium transferring unit may include a leading edge holding unit which holds a leading edge part of the printing medium, and a trailing edge holding unit which holds the trailing edge part of the printing medium and releases the held state of the printing medium if the printing medium reaches a predetermined release position, and the method may include determining to apply the external disturbance prevention if the printing medium passes the release position.

The release of the held state of the trailing edge holding unit may be accomplished by an excess-transferring stage.

The trailing edge holding unit may include a pair of rollers provided to rotate to transfer the printing medium in the forward direction.

The image forming method may further include sensing a rotation number of one of the leading edge holding unit and the trailing edge holding unit; and determining whether the printing medium passes the release position on the basis of the sensed result.

The foregoing and/or other aspects and utilities of the present general inventive concept may also be achieved by providing a computer readable medium storing a program to execute an image forming method including transferring the printing medium in a forward direction past a predetermined target position, transferring the printing medium in a backward direction to the target position, and positioning the printing medium at the target position.

The image forming method executed by the program stored on the computer readable medium may further include forming an image on the printing medium at the target position.

The foregoing and/or other aspects and utilities of the present inventive concept may also be achieved by providing an image forming apparatus, comprising a medium transferring unit to transfer a printing medium along a transfer path; and a controller to control the medium transferring unit to transfer the printing medium in at least two directions in an external disturbance prevention mode used to transfer the printing need in a single direction in a normal transferring mode.

The image forming apparatus may include the single direction is a medium transferring direction of the printing medium.

The image forming apparatus may include that at least two directions are forward and backward directions with respect to a medium transferring direction of the printing medium.

The image forming apparatus may include that at least two directions comprise a forward direction in which the printing medium is fed along a medium transferring direction of the printing medium, a backward direction in which the printing medium is fed back along the medium transferring directions and a second forward direction in which the printing medium is fed along the medium transferring direction.

The image forming apparatus may include that at least two directions comprise at least one forward direction of a medium transferring direction and at least one backward direction of the medium transferring direction, and the controller controls the medium transferring unit to transfer the printing medium by a first distance in the forward direction all by a second distance into backward direction.

The image forming apparatus may include the first distance is longer than the second distance.

The image forming apparatus may include the normal transferring mode and the external disturbance prevention mode are between printing operations in which unit line images are formed on the printing medium.

BRIEF DESCRIPTION OF THE DRAWINGS

The above and/or other aspects of the present general inventive concept will become apparent and more readily appreciated from the following description of the exemplary embodiments, taken in conjunction with the accompanying drawings, in which.

DETAILED DESCRIPTION OF THE PREFERRED EMBODIMENTS

Figure 1:
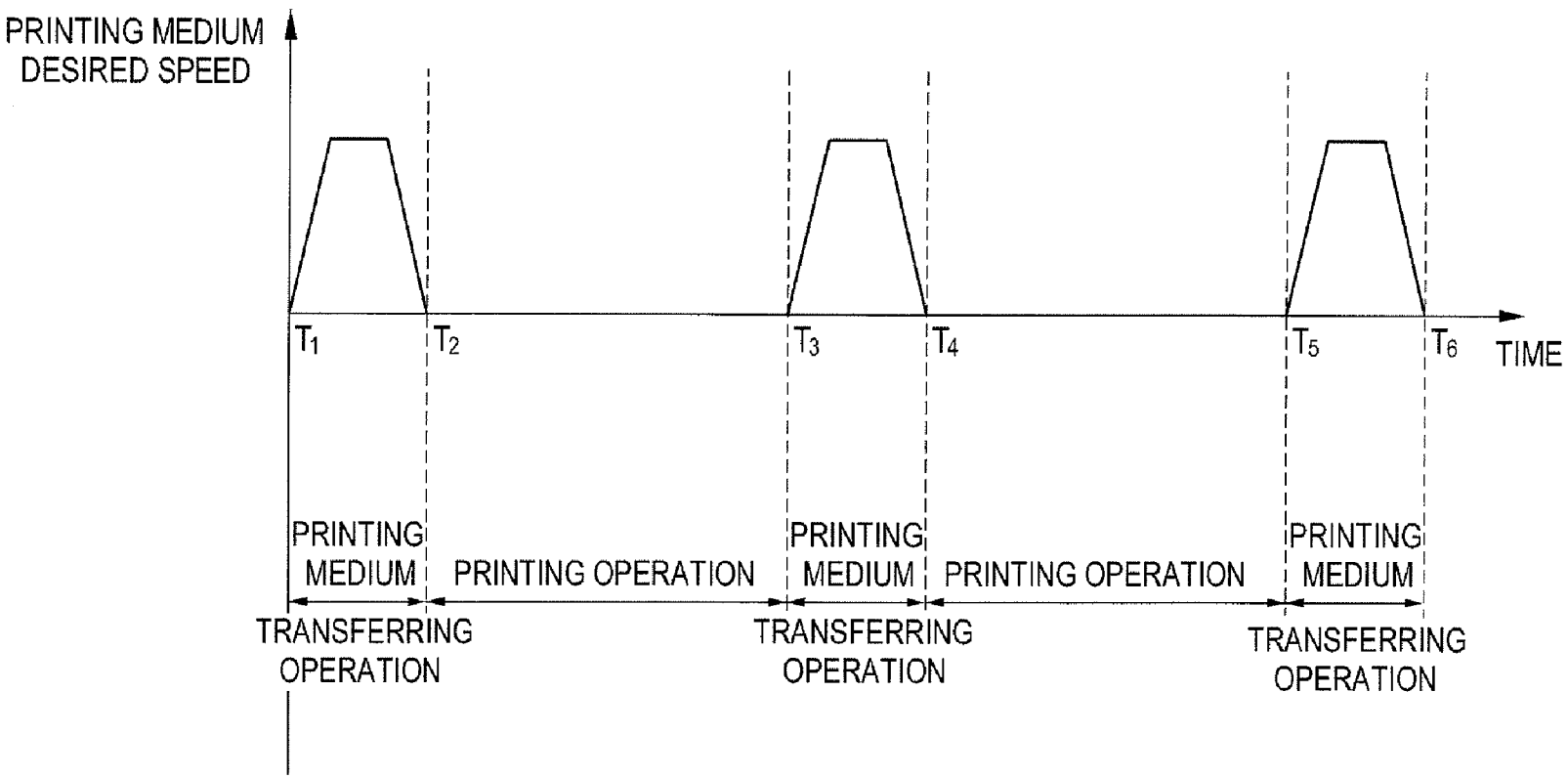
FIG. 1 (RELATED ART)
FIG. 1 is a schematic exemplary view illustrating a desired speed profile of a printing medium of a conventional ink jet printer.

Reference will now be made in detail to the embodiments of the present general inventive concept, examples of which are illustrated in the accompanying drawings, wherein like reference numerals refer to like elements throughout. The embodiments are described below so as to explain the present general inventive concept by referring to the figures.

Figure 3:
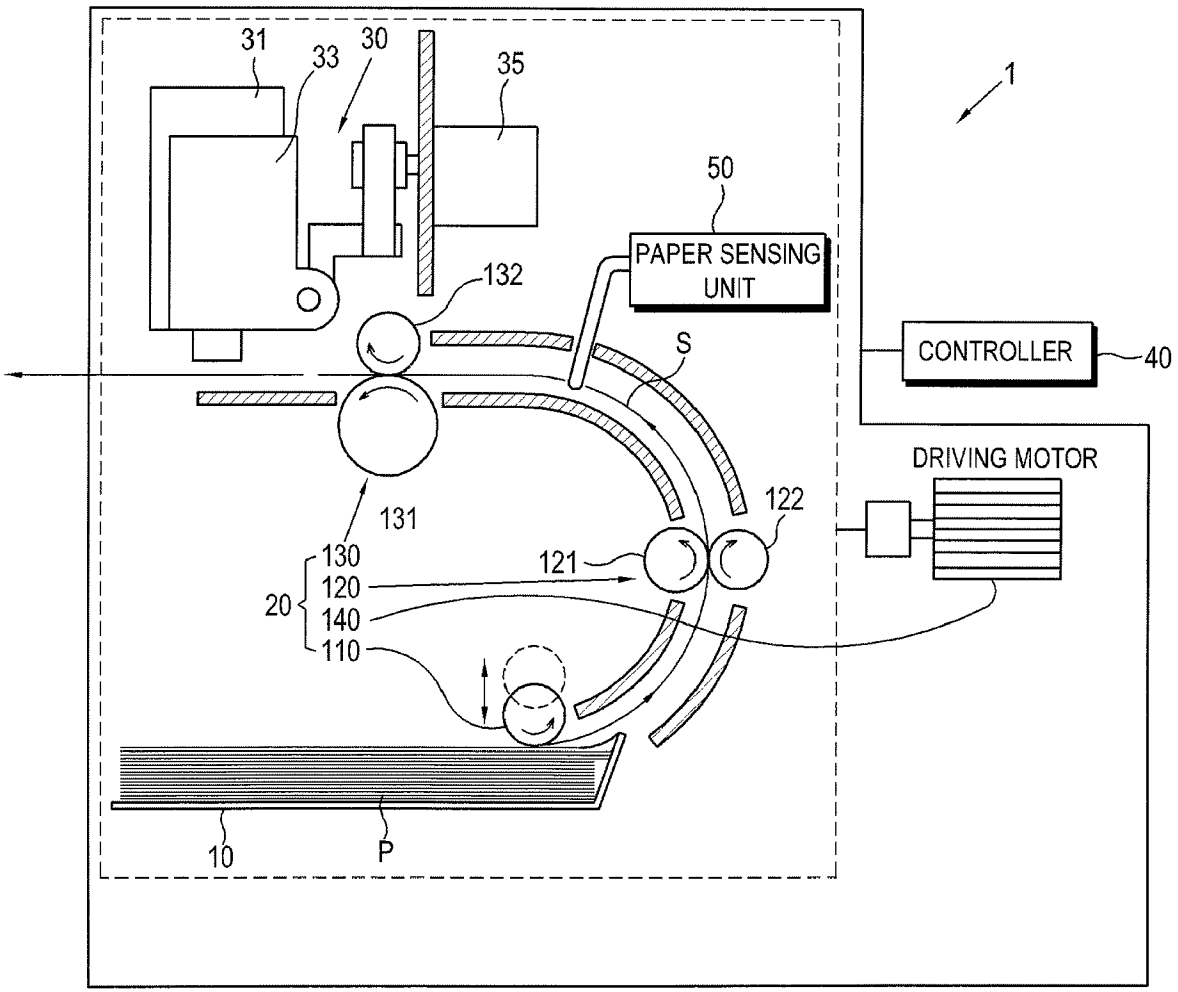
FIG. 3 is a schematic sectional view illustrating an ink jet printer according to and embodiment of the present general inventive concept.

As illustrated in FIG. 3, the image forming apparatus 1 according to an embodiment of the present general inventive concept includes a feeding cassette 10, a medium transferring unit 20, an image forming unit 30, a controller 40, and a printing medium sensing unit 50.

As illustrated in FIG. 3, the medium transferring unit 20 includes a pick-up roller 110, a trailing edge holding unit 120, a leading edge holding unit 130, and a driving motor 140. The medium transferring unit 20 transfers a printing medium P loaded on the feeding cassette 10 along a transferring direction S toward the image forming unit 30.

The trailing edge holding unit 120 may include a driving roller 121 and a driven roller 122, and the leading edge holding unit 130 may include a feeding roller 131 and an idle roller 132.

The driving motor 140 rotationally drives the feeding roller 131 in forward and reverse directions. A driving pinion (not shown) is assembled with a rotational shaft of the driving motor 140. Also, a feeding gear (see 133 in FIG. 4) installed on the rotational shaft of the feeding roller 131 of the leading edge holding unit 130 is gear-assembled with the driving pinion to be driven by the driving motor 140. The driving motor 140 may be provided as a DC motor. An encoder (not shown) may be installed in one end part of a rotational shaft (not shown) of the feeding roller 131 to sense the rotational number of the feeding roller 131. The driving motor 140 may be provided as another type of motor, such as a stepping motor, as desired.

Figure 4:
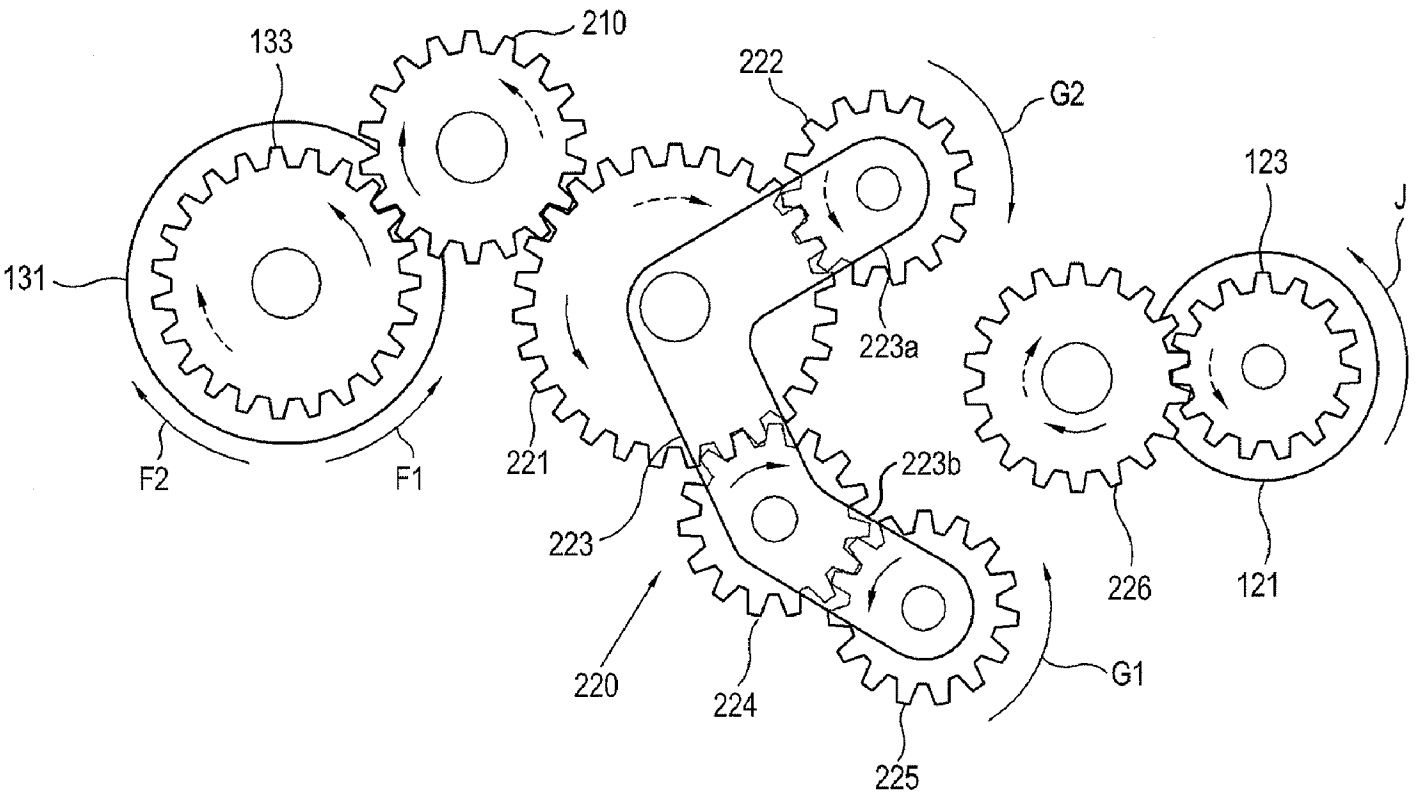
FIG. 4 is an enlarged view illustrating an engaging operation of a leading edge holding unit and a trailing edge holding unit of the ink jet printer in FIG. 3.

As illustrated in FIG. 4, the medium transferring unit 20 may further include a first gear row 220 to enable the driving roller 121 of the trailing edge holding unit 120 to rotate in engagement with the feeding roller 131. The first gear row 220 further includes a gear 221 whose rotational shaft is fixed (or coupled), and a swing arm 223 which is provided to swing with respect to the rotational shaft of the gear 221. The swing arm 223 has a first swing unit 223*a* assembled with a gear 222 and a second swing unit 223*b* assembled with gears 224 and 225.

The driving roller 121 may be operated to rotate only in a direction J to transfer the printing medium toward the leading edge holding unit 130 regardless of a forward rotation F1 and a reverse rotation F2 of the feeding roller 131. In more detail, the feeding gear 133 installed on the rotational shaft of the feeding roller 131 is engaged with a mid-gear 210, and the mid-gear 210 is engaged with the gear 221 of the first gear row 220.

Here, the swing arm 223 swings and rotates in a direction G2 during the reverse rotation F2 of the feeding roller 131 and the gear 222 assembled with the first swing unit 223*a* is engaged with a gear 226. Accordingly, the driving gear 123 and the driving roller 121 installed on the rotational shaft of the driving roller 121 to rotate with the driving roller 121 are rotated in the direction J. On the other hand, if the feeding roller 131 rotates in the forward direction F1, the swing arm 223 swings and rotates in a direction G1 and the gear 225 assembled with the second swing unit 223*b* is engaged with the gear 226. Accordingly, the driving roller 121 rotates in the same J direction. That is, the driving roller 121 can always rotate in the uniform J direction, namely, only in a direction to enable the printing medium P to proceed in the transferring direction S regardless of the forward and reverse directions of the feeding roller 131.

A one-way gear may be used in place of the swing arm 223 so that the driving roller 121 can rotate in the uniform direction J, as necessary.

Figure 5:
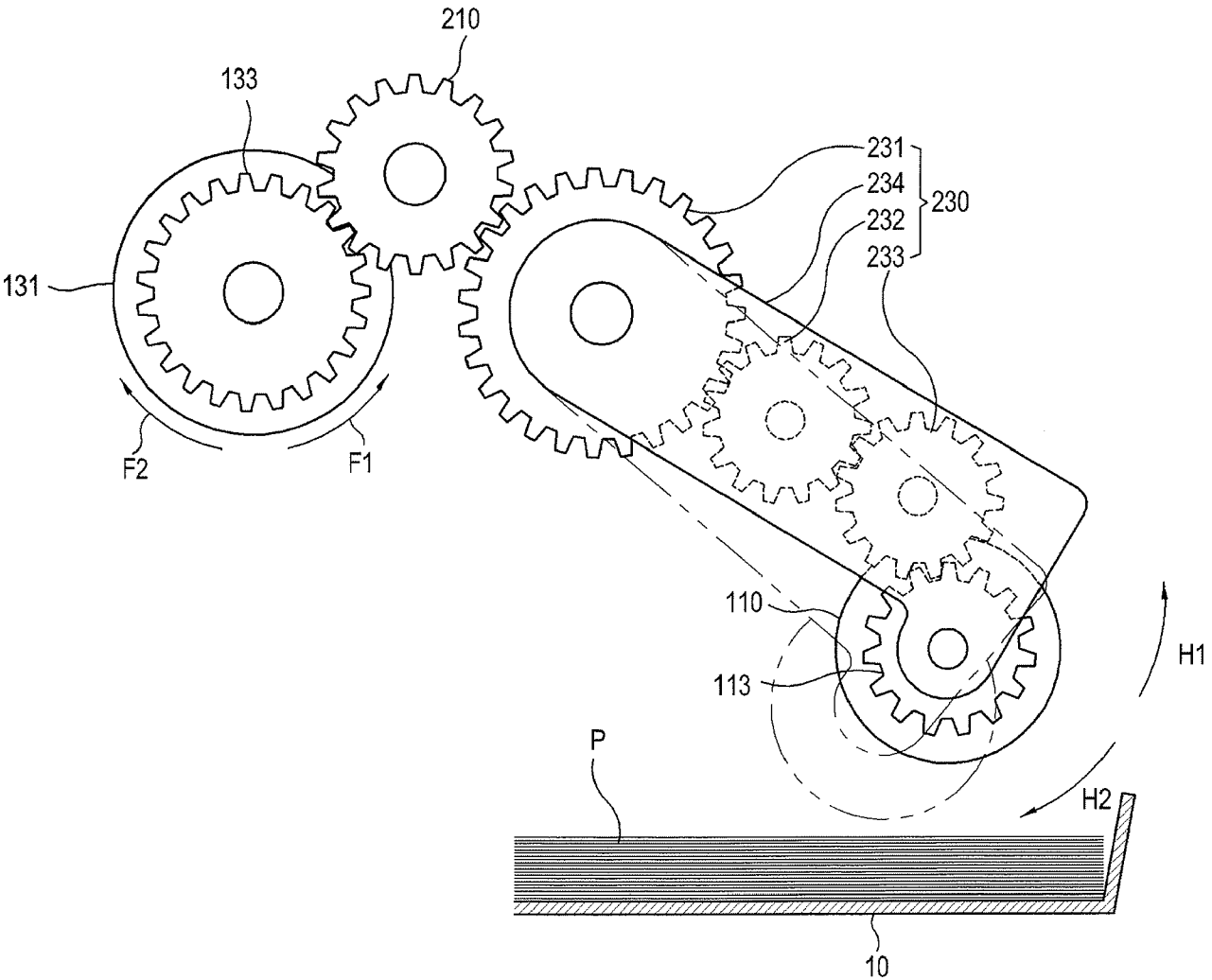
FIG. 5 is an enlarged view illustrating an engaging operation of a leading edge holding unit and a pick-up unit of the ink jet printer in FIG. 3.

As illustrated in FIG. 5, the medium transferring unit 20 may include a second gear row 230 for power-rotating the feeding roller 131 and the pick-up roller 110.

The second gear row 230 has a plurality of gears 231, 232, and 233 and a pick-up arm 234. The gear 231 receives a driving force from the feeding gear 133 through the mid-gear 210. The pick-up arm 234 is provided to rotate with respect to the rotational shaft of the gear 231. Accordingly, if the feeding roller 131 rotates in the reverse direction F2, the pick-up arm 234 rotates in a direction H2 and contacts and presses the printing medium P loaded on the feeding cassette 10 to transfer the same toward the trailing edge holding unit 120. On the other hand, if the feeding roller 131 rotates in the forward direction F1, the pick-up arm 234 rotates in a direction H1 to be separated from the printing medium P.

Referring again to FIG. 3, the image forming unit 30 includes a printing head 31 in which plural nozzles (not shown) are formed to face toward the printing medium P, a carriage 33 on which the printing head 31 is mounted to reciprocally move in a transverse direction with respect to a transferring direction S of the printing medium P, and a carriage motor 35 which drives the carriage 33.

The controller 40 controls the medium transferring unit 20 to transfer the printing medium P loaded on the feeding cassette 10 to a position where the image forming unit 30 starts printing. Briefly describing the process, as illustrated in FIGS. 3,4, and 5, the controller 40 controls the driving motor 140 to drive the feeding roller 133 the reverse direction F2 so that the printing medium P is picked up by pickup roller 110 and transferred towards the trailing edge holding unit 120 (including driving roller 121 and driven roller 122). The picked up printing medium remains in a held state between the driving roller 121 and the driven roller 122 of the trailing edge holding unit 120 to be transferred to the leading edge holding unit 130.

The paper sensing unit 50 is disposed between the trailing edge holding unit 120 and the leading edge holding unit 130 to sense whether the printing medium P is being transferred to the leading edge holding unit 130. The printing medium sensing unit 50 may be a known paper sensing sensor such as a contact sensor or a light sensor.

After the printing medium P is sensed by the printing medium sensing unit 50, a rotation number of the feeding roller 133 is sensed from the encoder (not shown) installed on the feeding roller 133 and the position of the printing medium may be determined from the rotation number of the feeding roller 133 to determine when the printing medium P reached the leading edge holding unit 130. If necessary, the printing medium sensing unit 50 may be omitted because the position of the printing medium may be estimated on the basis of the ration number of the feeding roller 133 sensed by the encoder.

The controller 40 rotates the feeding roller 133 in the reverse direction F2 to transfer the printing medium P in the transferring direction S until the trailing edge of the printing medium P is separated from the pick-up roller 110. When the trailing edge of the printing medium P is separated from the pick-up roller 110, the controller 40 rotates the feeding roller 133 in the forward direction F1, and accordingly, the pick-up roller 110 is moved in the direction H1 in FIG. 5 and separated from the printing medium P of the feeding cassette 10. From this time, the printing medium P is transferred in the transferring direction S by the trailing edge holding unit 120. Here, whether the tailing edge of the printing medium P has separated from the pick up 110 may be determined from the rotation number of the feeding roller 110 as determined by an encoder (not shown). Alternatively, if the printing medium sensing unit 50 is disposed at a location to first sense the printing medium P when the trailing edge of the printing medium P starts to be separated from the pick-up roller 110, the printing medium sensing unit 50 may be used to determine whether the trailing edge has been separated from the pick-up roller 110.

Then, the printing medium P is transferred by the trailing edge holding unit 120 so that its leading edge is held by the leading edge holding unit 130, and is then transferred to the image forming unit 30 by both the leading edge holding unit 130 and the trailing edge holding unit 120. Accordingly, the printing medium P is transferred to a position just before printing starts by the image forming unit 30. Here, a position of the trailing edge of the printing medium P at a time when a printing first starts in a printing area A of the printing medium P will be referred to as X(1), that is, a first target position. The printing medium P is illustrated to be in the first target position X(1) in FIG. 7.

Figure 8:
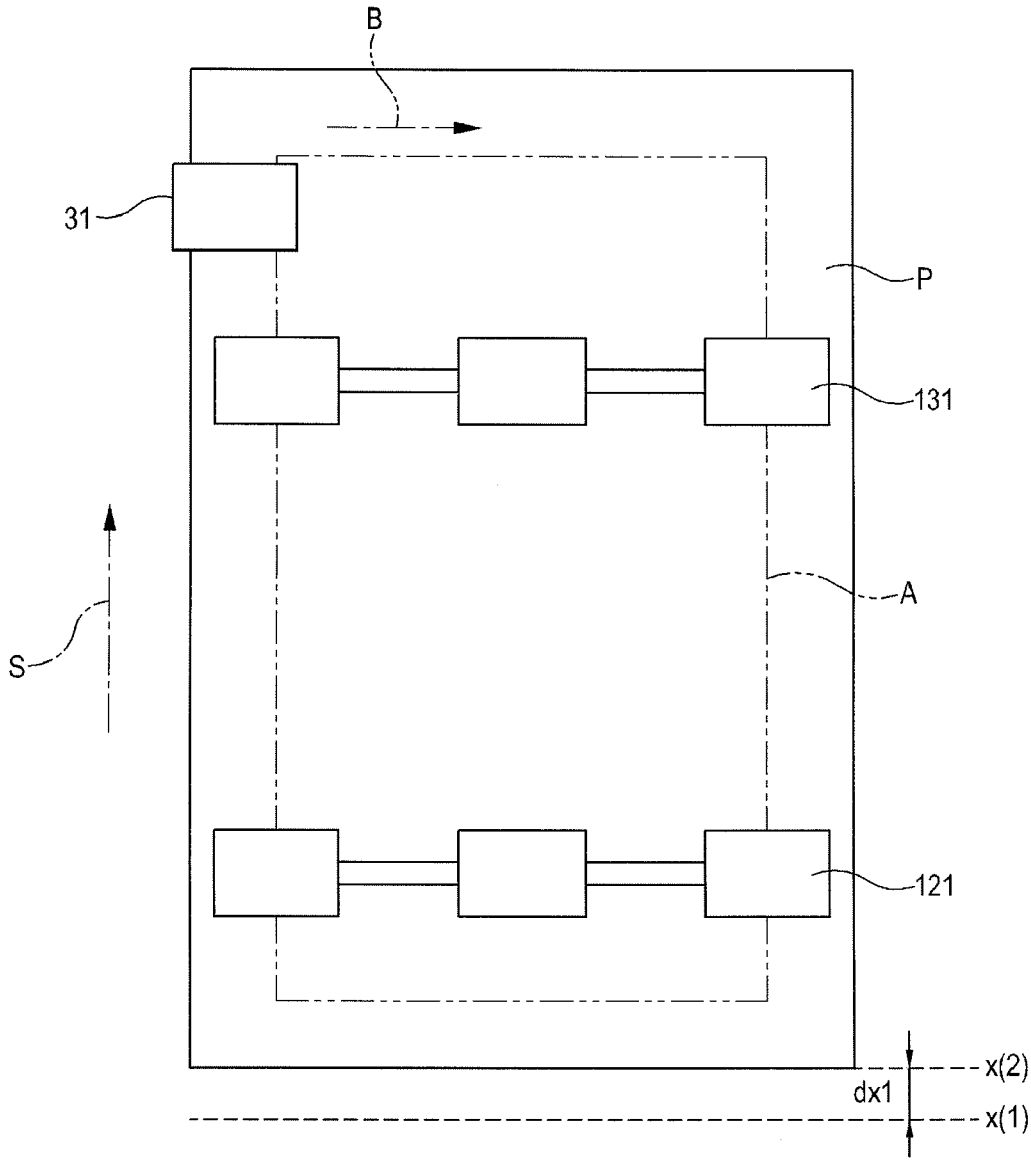
FIG. 8 is a schematic figure illustrating an internal portion of the ink jet printer in FIG. 3 after a printing medium is unit-transferred from the position in FIG. 7.

After reaching the first target position X(1), the controller 40 unit-transfers the printing medium P by a predetermined amount dX1 in the transferring direction S and repeats this process to form an image on the printing medium as illustrated in FIG. 8. Hereinafter, a printing medium transferring method controlled by the controller 40 will be described in detail.

For convenience's sake, a target position immediately after the printing medium is unit-transferred from X(1) will be referred to as X(2), and a target position immediately after the printing medium is unit-transferred after X(2) will be sequentially referred to as X(n) (n denoting an integer three or greater).

Figure 6:
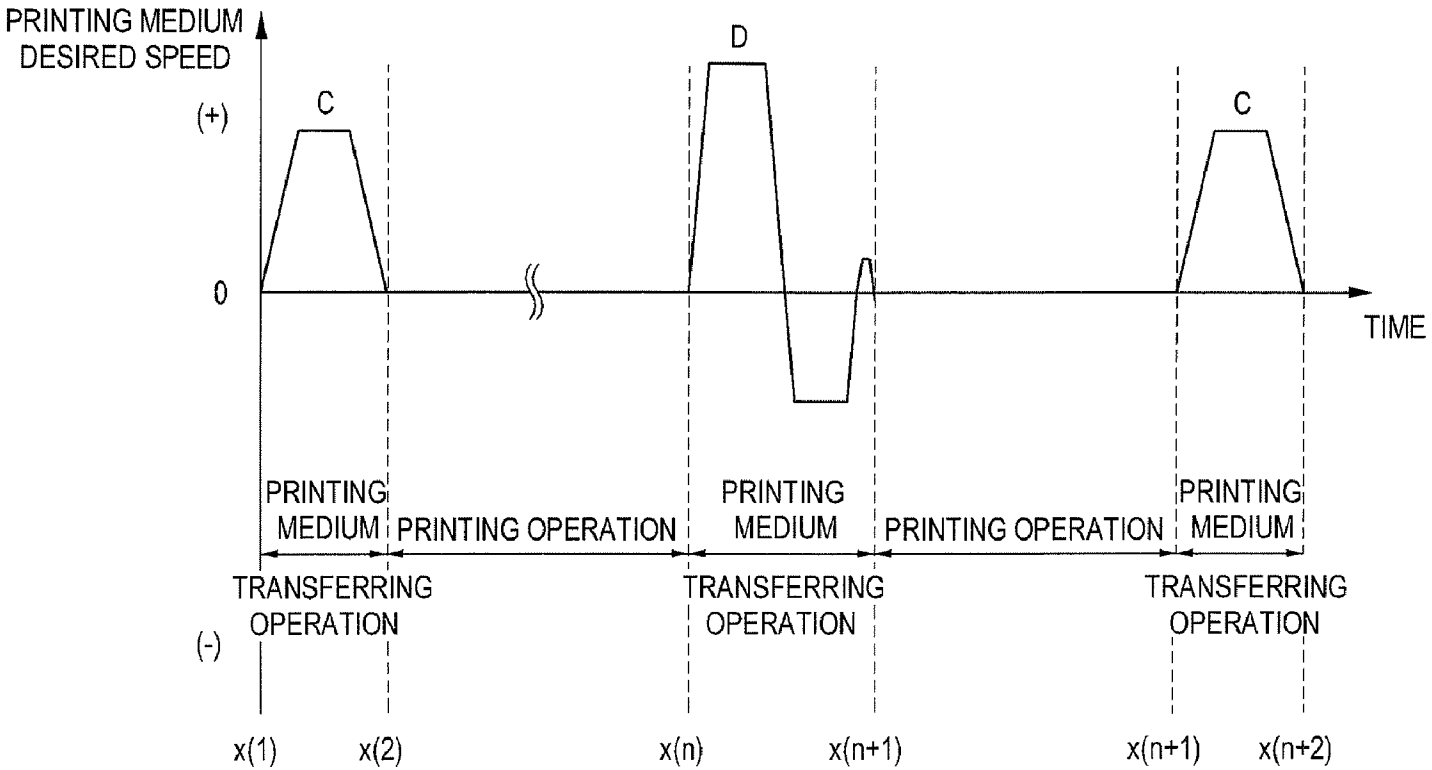
FIG. 6 is an exemplary view illustrating a desired speed profile of a printing medium of the ink jet printer in FIG. 3.

The controller 40 controls the medium transferring unit 20 so that the printing medium can follow a desired speed profile such as that illustrated in section C of FIG. 6 in a general mode of operation. In this general mode of operation, the printing medium is transferred only in the forward transferring direction S. On the other hand, the controller 40 controls the medium transferring unit 20 so that the printing medium can follow the desired speed profile such as that illustrated in section D of FIG. 6 in an external disturbance prevention mode of operation. In this external disturbance prevention mode of operation, the controller 40 transfers the printing medium in the forward and backward directions with respect to the target position.

The controller 40 may first determine whether the external disturbance prevention mode will need to be applied to or not in advance of each unit-transferring operation. The external disturbance prevention mode may be applied only in a particular unit-transferring operations having a high possibility of an external disturbance while the general mode may be applied for the other unit-transferring operations, as necessary. Alternatively, if the all unit-transferring operations are performed according to the external disturbance prevention mode, the controller 40 does not need to determine whether the external disturbance prevention mode should be applied or not.

The selection of the external disturbance prevention mode may be determined by whether the trailing edge of the printing medium has passed a release position (see R in FIG. 9) where the printing medium is released from its held state from the trailing holding unit 120. This determination may be made after each unit-transferring operation by calculating the position of the printing medium from the rotation number of the feeding roller 131 detected by the encoder (not shown). If the trailing edge of the printing medium P is determined to be inside the release position prior to a unit-transferring operation to be performed, it may be determined to operate in the external disturbance prevention mode. In addition, it may be determined to operate in the external disturbance prevention mode when the trailing edge of the printing medium may possibly be separated from the trailing edge holding unit 120 during a printing process by the image forming unit 30. This may occur if the trailing edge of the printing medium is weakly held in the trailing edge holding unit 120 even though the trailing edge of the printing medium P is not within the release position R. For example, when the trailing edge of the printing medium is proximate to the release position R but still held by the trailing edge holding unit 120, it may be determined to operate in the external disturbance prevention mode.

If there is little possibility of an external disturbance occurring in the unit-transferring operation from X(1) to X(2), the controller 40 may unit-transfer the printing medium according to the general mode. That is, the controller 40 transfers the printing medium P only in a forward direction from a position in FIG. 7 to a position in FIG. 8 or from X(1) to X(2) by a predetermined amount dX1 and stops the printing medium P. Also, the controller 40 enables printing head 31 of the image forming unit 30 to move in a transverse direction B to the printing medium P to form one line of the ink image.

Hereinafter, the transferring method of the printing medium will be described by referring FIGS. 9 to 11 in case that the external disturbance prevention mode is applied.

Figure 9:
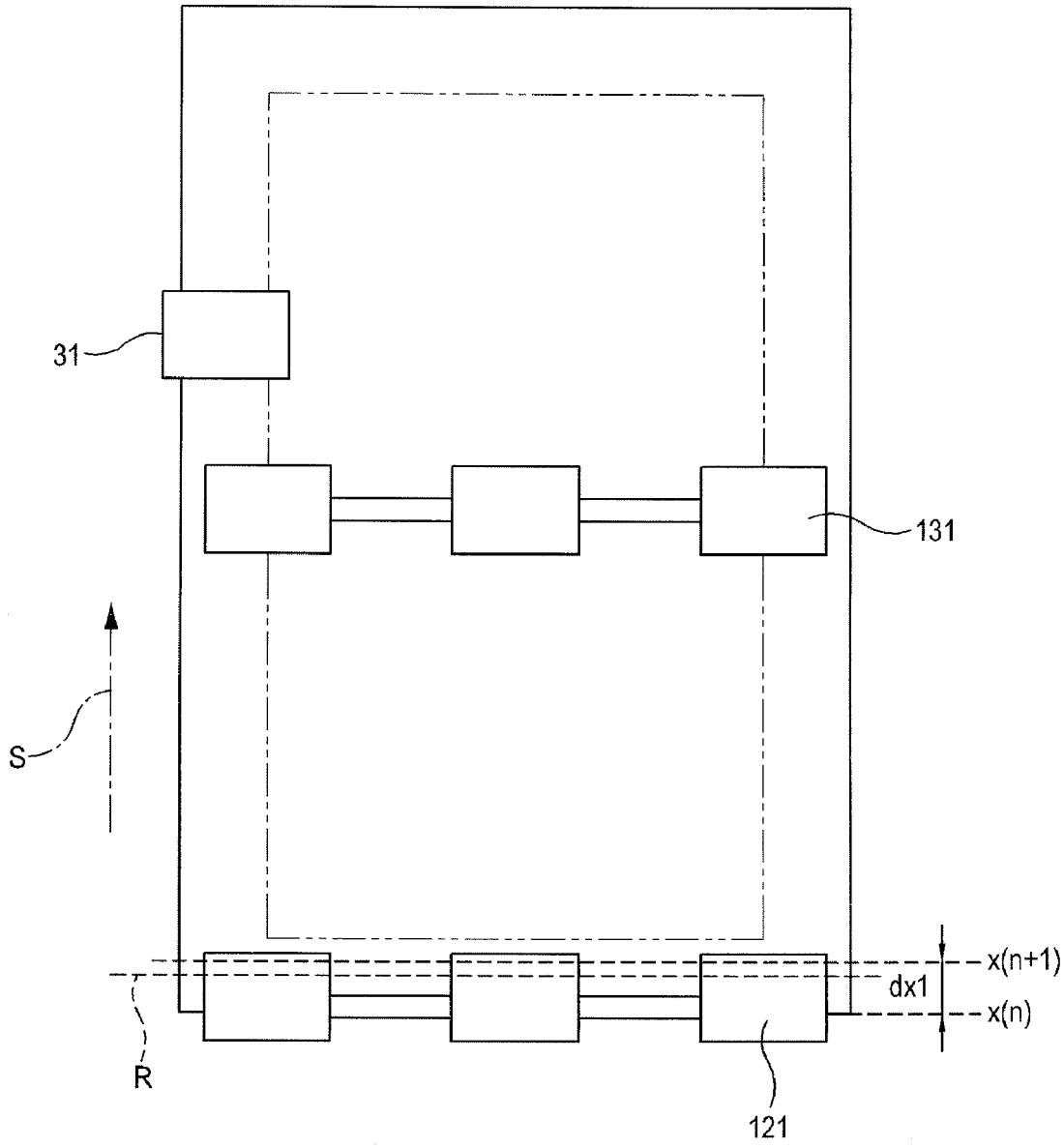
FIG. 9 is a schematic figure illustrating an internal portion of the ink jet printer in FIG. 3 just before an external disturbance prevention mode is applied.
Figure 10:
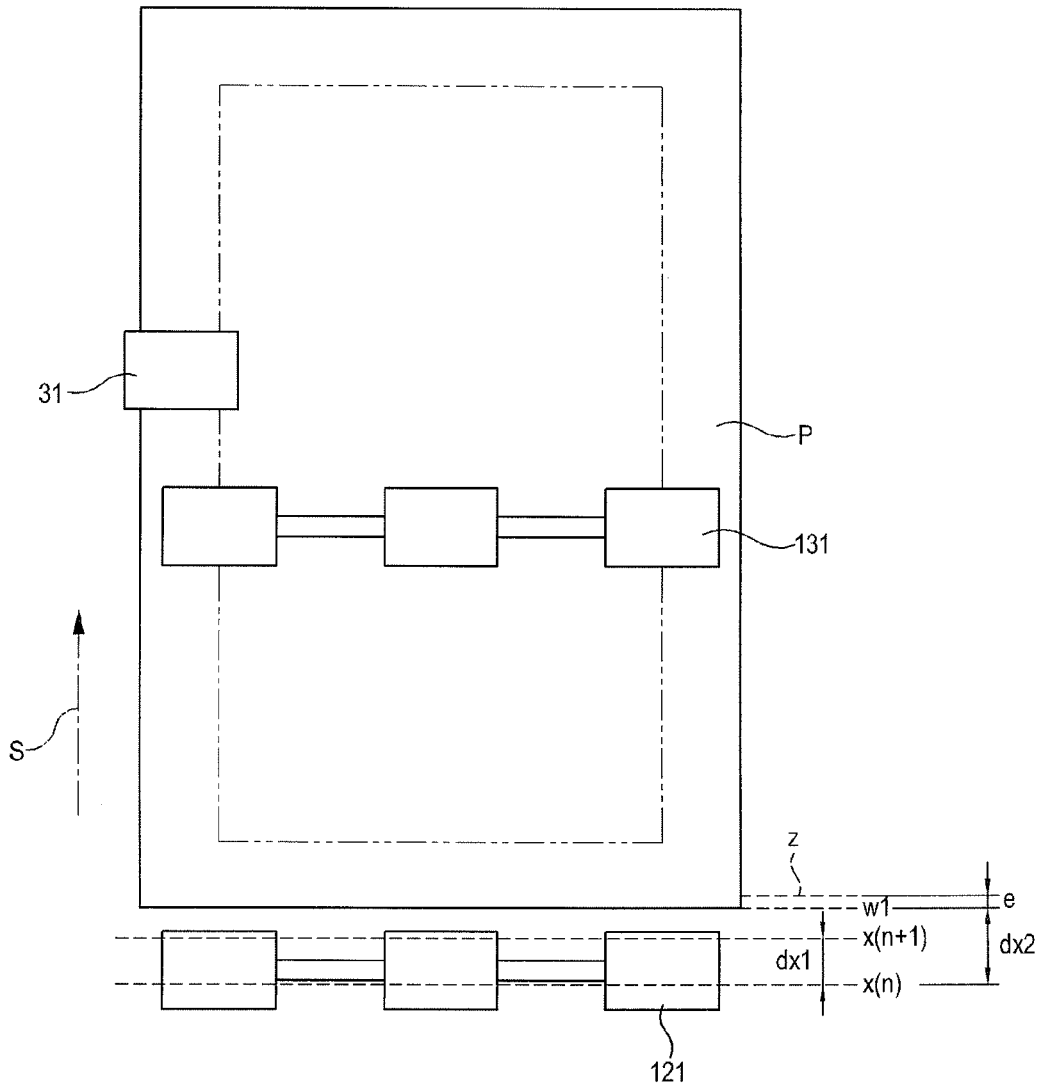
FIG. 10 is a schematic figure illustrating an internal portion of the ink jet printer in FIG. 3 in a state that the printing medium in FIG. 9 is excess-transferred according to an external disturbance prevention mode.
Figure 11:
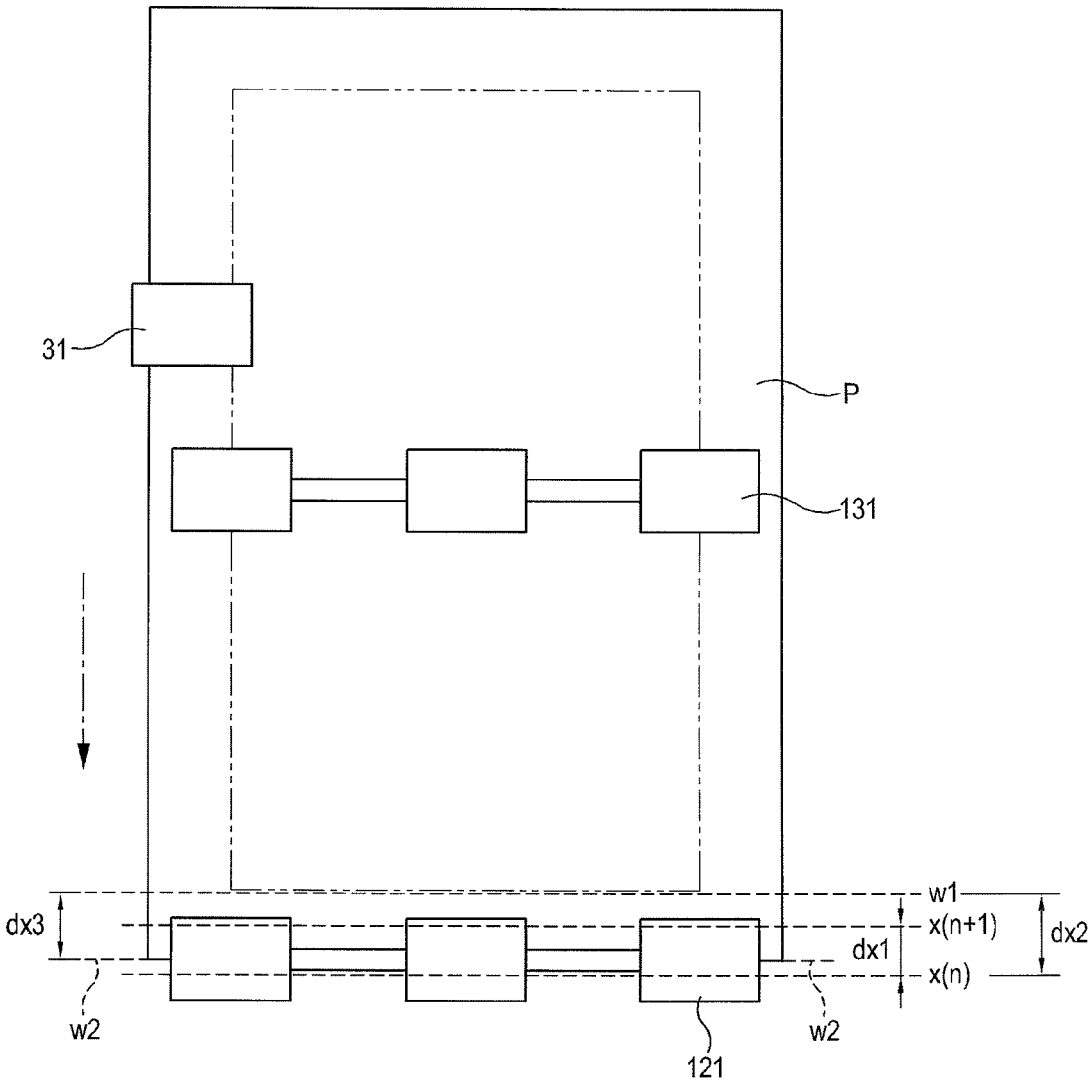
FIG. 11 is a schematic figure illustrating an internal portion of the ink jet printer in FIG. 3 in a state that the printing medium in FIG. 10 is retreat-transferred.

FIGS. 9 to 11 are figures sequentially illustrating the internal part of the image forming apparatus 1 when the external disturbance prevention mode is applied. First, FIG. 9 represents the image forming apparatus 1 just before the unit-transferring operation in the external disturbance prevention mode is applied.

Figures 2A, 2B, 2C:
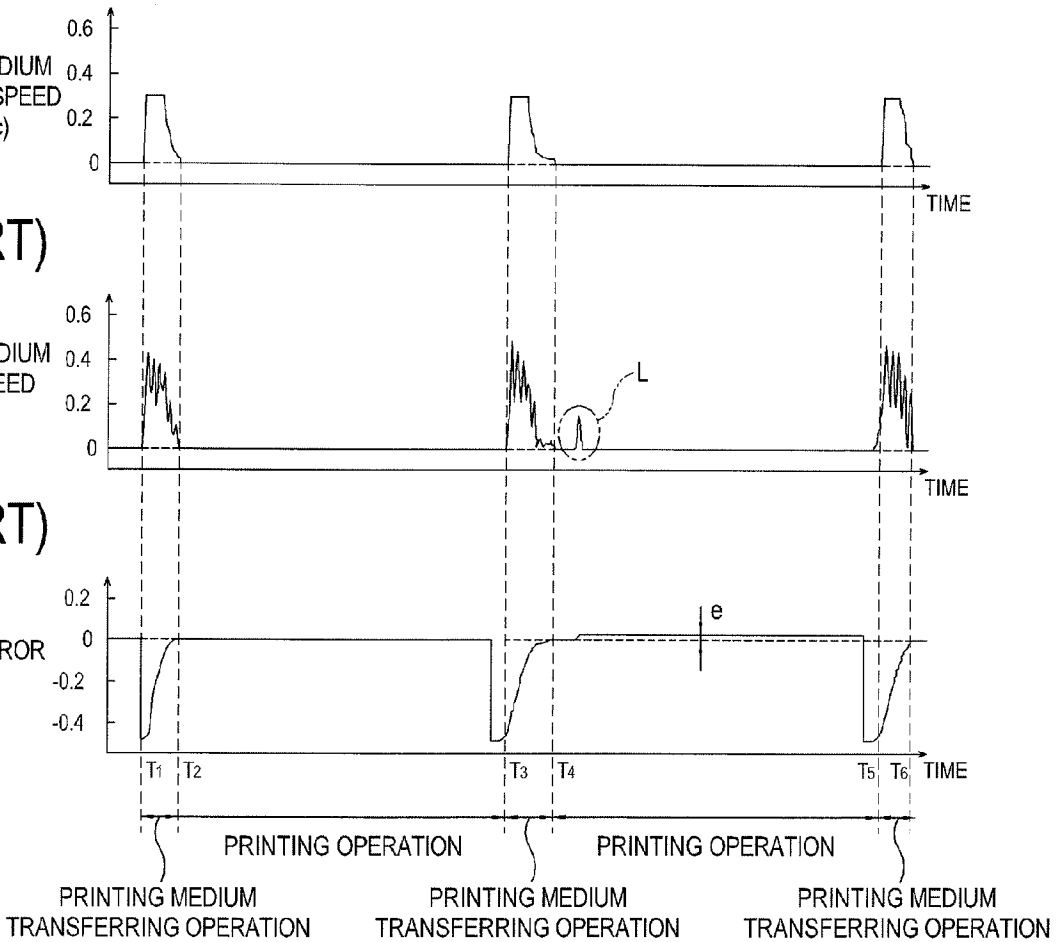
FIG. 2A(RELATED ART)
FIG. 2B(RELATED ART)
FIG. 2C(RELATED ART)
FIGS. 2A to 2C are graphs illustrating a printing medium desired speed which is applied to the conventional ink jet printer, and an example printing medium actual transferring speed profile and a position error with respect to a target position of a printing medium according to the desired speed profile in FIG. 2A, respectively.

The external disturbance, such as L illustrated in FIG. 2, is more likely to occur when the trailing edge of the printing medium is weakly held in the trailing edge holding unit 120 or when the trailing edge of the printing medium passes the release position R where its held state is released from the trailing edge holding unit 120. As illustrated in FIG. 3, if the image forming apparatus 1 has a transferring route in the shape of a "C" so as to minimize the size of a product, the moment the trailing edge of the printing medium P is separated from the trailing holding unit 120, (its held state is released), the bent trailing edge of the printing medium P flattens out and vibration is induced on the printing medium P. The induced vibration onto the printing medium may cause the printing medium P to deviate from the target position. If an image is formed when the printing medium has deviated from the target position, an image defect such as a white line, or a black line occurs. In particular, if the printing medium P is a thick paper such as a photographic paper, the external disturbance becomes even bigger, and the image defect can be more easily recognized by the naked eye during a photo printing, especially in view of the high definition quality usually demanded for photographic print.

X(n) in FIG. 9 denotes a position where the trailing edge of the printing medium is held by the trailing edge holding unit 120, and X(n+1) denotes a target position after the trailing edge of the printing medium held by the trailing edge holding unit 120 is released. The printing medium P passes the release position R as it is unit-transferred from X(n) to X(n+1). That is, its held state is released during the unit-transferring operation from X(n) to X(n+1) from the trailing edge holding unit 120.

The controller 40 can perform a unit-transferring operation in the external disturbance prevention mode during the unit-transferring operation from X(n) to X(n+1). Here, the feeding roller 131 of the leading edge holding unit 130 may be rotated in forward and reverse rotations F1 and F2, respectively so that the printing medium P can be transferred to the forward transferring direction S and a direction opposite the forward transferring direction S.

Hereinafter, a unit-transferring operation according to the external disturbance prevention mode will be described. First, as illustrated in FIG. 10, the printing medium P is excess-transferred by an excess-transfer amount dX2 from X(n) in the transferring direction S. Here, the excess-transfer amount dX2 is provided to be larger than the transfer amount dX1 of the general mode.

Also, as illustrated in FIG. 11, the printing medium P is retreat-transferred by an amount dX3 from the excess-transfer position W1 in the direction opposite to transferring direction S so that the printing medium P is positioned in a retreat position W2. The retreat-transfer amount dX3 is larger from the difference of the excess-transfer amount dX2 and the unit-transfer amount dX1 so that the trailing edge of the printing medium is retreat-transferred past the target position X(n+1).

Figure 12:
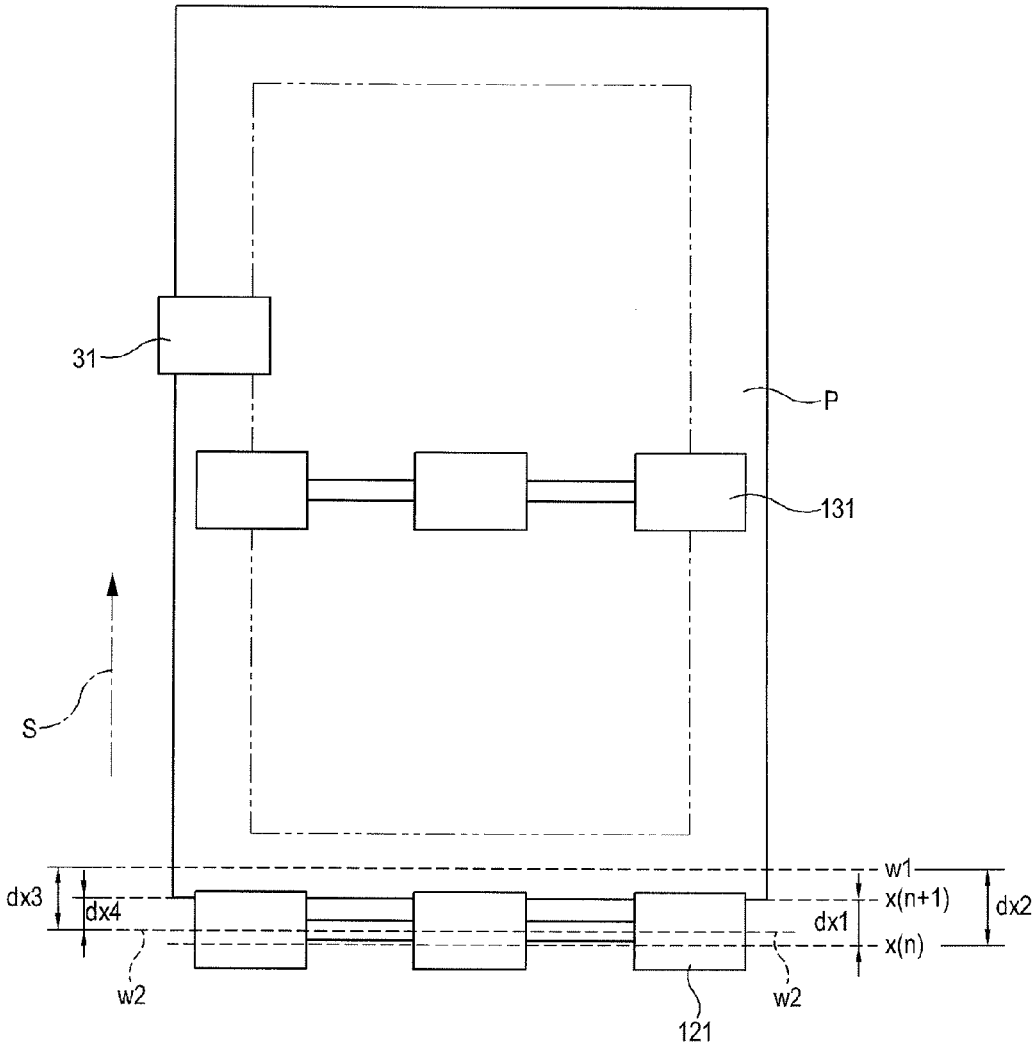
FIG. 12 is a schematic figure illustrating an internal portion of the ink jet printer in FIG. 3 in a state that the printing medium in FIG. 11 is transferred to a target position.

Then, as illustrated in FIG. 12, having retreat-transferred printing medium P, the printing medium P is transferred in the transferring direction S by a forward transfer amount dX4 so that the trailing edge of the printing medium P is positioned at target position X(n+1).

Here, although the printing medium is intended to be excess-transferred from position X(n) to the excess-transfer position W1, a position error may be induced by the release of the printing medium P by the trailing edge holding unit 120. That is, although the controller 40 controls the medium transferring unit 20 to transfer the printing medium P by the excess-transfer amount dX2, the printing medium may be positioned at another position instead of the excess-transfer position W1 because of the external disturbance due to the release of the held state during the excess-transfer. For example, as illustrated in FIG. 10, the trailing edge of the printing medium P may end up at position Z instead of the excess-transfer position W1.

In this case, the controller 40 may calculate the position error e from the rotation number of the feeding roller 131 of the encoder (not shown), and can offset the position error e during a transferring process of either the retreat-transfer or the forward transfer. For example, the printing medium P may be retreat-transferred by the retreat-transfer amount dX3 plus the position error e so that the position error can be offset and the printing medium P can be transferred to the desired retreat position W2.

In addition, if the leading holding unit 130 and the driving motor 140 are assembled with each other by a gear, there may be a separate position error due to a gear backlash during the retreat-transfer. Accordingly, if the printing medium is forward transferred again after the retreat-transfer, the position error induced by the gear backlash can be offset.

Also, if the held state of the printing medium by the trailing edge holding unit 120 in a position X(n) can be easily released by the movement of or impacts to the image forming unit 30, the external disturbance prevention mode may be applied in the unit-transferring operation from a position X(n−1) to the position X(n), as desired. That is, if the trailing edge of the printing medium P is proximate to the release position R, the controller 40 may determine to control the medium transferring unit 30 to perform the unit-transfer according to the external disturbance prevention mode for the unit-transfer operation from the position X(n−1) to the position X(n). As noted above, this helps prevent the position of the printing medium P from being other than at the desired position during printing.

Figure 13:
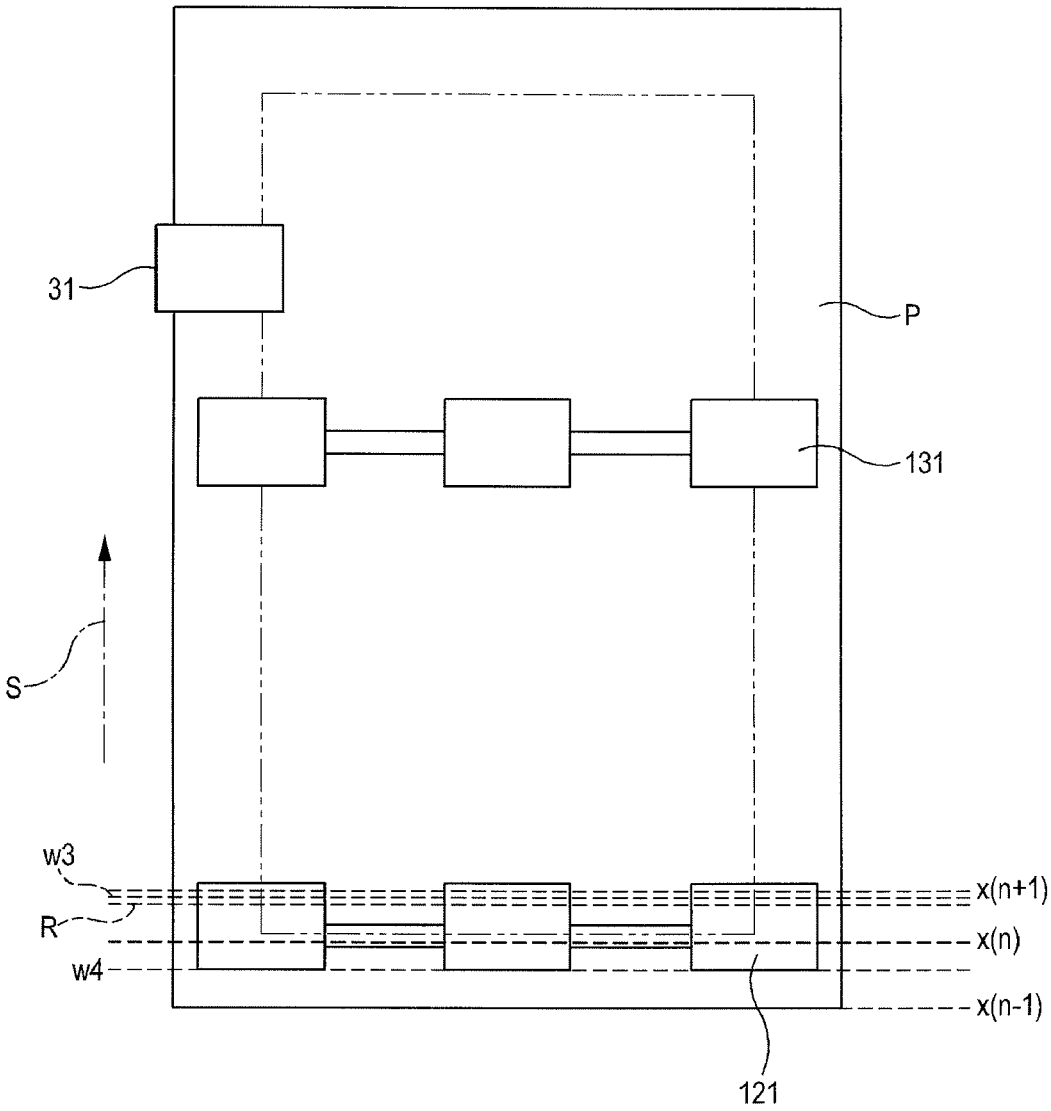
FIG. 13 is a schematic figure illustrating an internal portion of the ink jet printer in FIG. 3 in connection with another unit-transfer operation.

As illustrated in FIG. 13, after the printing medium P is excess-transferred in the transferring direction S from X(n−1) to the excess-transfer position W3, it is retreat-transferred to a retreat position W4. Here, the excess-transfer position W3 may be properly determined so that the trailing edge of the printing medium can be released from its held state by the trailing edge holding unit 120. The retreat position W4 may be provided between X(n−1) and X(n). Of course, the retreat position W4 may be any position past the target position X(n) in the direction opposite the transferring direction S. The retreat position may also be a position past position X(n−1) in the direction opposite the transferring direction S, as desired. Although the printing medium P may be transferred to X(n−1), the printing medium P may not be held by the trailing edge holding unit 120 since the trailing edge holding unit 120 may be rotatable so that the printing medium P proceeds only in the transferring direction S.

In addition, the printing medium in the retreat position W4 is forward transferred in the transferring direction S again to position the printing medium at the target position X(n). Here, if the printing medium is unit-transferred according to the external disturbance prevention mode in the unit-transfer operation from X(n−1) to X(n), the printing medium P may be unit-transferred according to the general mode from X(n) to X(n+1). That's because there is a lower possibility of an external disturbance occurring due to the trailing edge holding unit 120 while the printing medium P is being unit-transferred from X(n) to X(n+1) since the trailing edge of the printing medium P has been already released from its held state in the trailing edge holding unit 120 during the transfer of the printing medium P to the excess-transfer position W3 during the unit-transfer operation from X(n−1) to X(n). Alternatively, the printing medium may be unit-transferred according to the external disturbance prevention mode for several contiguous unit-transfer operations before and after the trailing edge of the printing medium P approaches the release position R.

In addition, rather than unit-transferring the printing medium P according to the external disturbance prevention mode only in one or several particular unit-transfer operations, the printing medium may be unit-transferred in the external disturbance prevention mode for every unit-transfer operation, if desired. However, while this option reduces the chances of an external disturbance creating a poor image, it increases the time to print an image on one sheet of printing medium. A designer may instead choose to unit-transfer the printing medium according to the external disturbance prevention mode only in some unit-transfer operation(s) where the occurrence of an external disturbance is expected or otherwise has a higher probability of occurring.

Figures 14A, 14B, 14C:
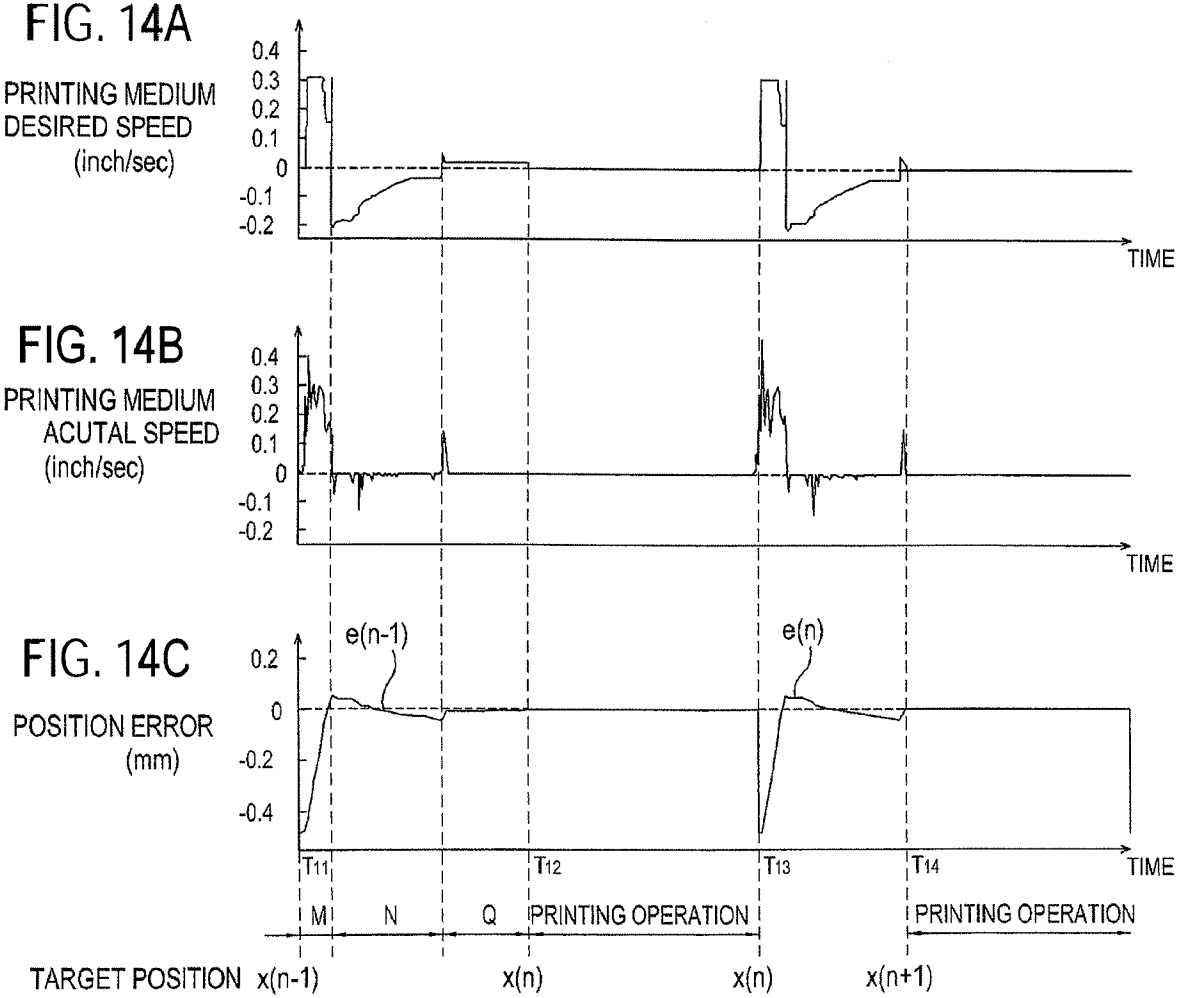
FIG. 14A is a graph illustrating a desired speed profile of the printing medium of the ink jet printer in FIG. 3.
FIGS. 14B and 14C are graphs illustrating a transferring speed profile and a position error of the printing medium measured according to FIG. 14A.

FIG. 14A is a graph illustrating an example of a desired speed profile of the printing medium in the external disturbance prevention mode, and FIGS. 14B and 14C are graphs respectively illustrating examples of an actual transferring speed and a position error of the printing medium according to the desired speed profile of FIG. 14A. Specifically, FIGS. 14A to 14C represent experimental data in a case that a photographic paper is unit-transferred in the external disturbance prevention mode when the photographic paper is unit-transferred from X(n−1) to X(n), and X(n) to the X(n+1), respectively.

Figure 7:
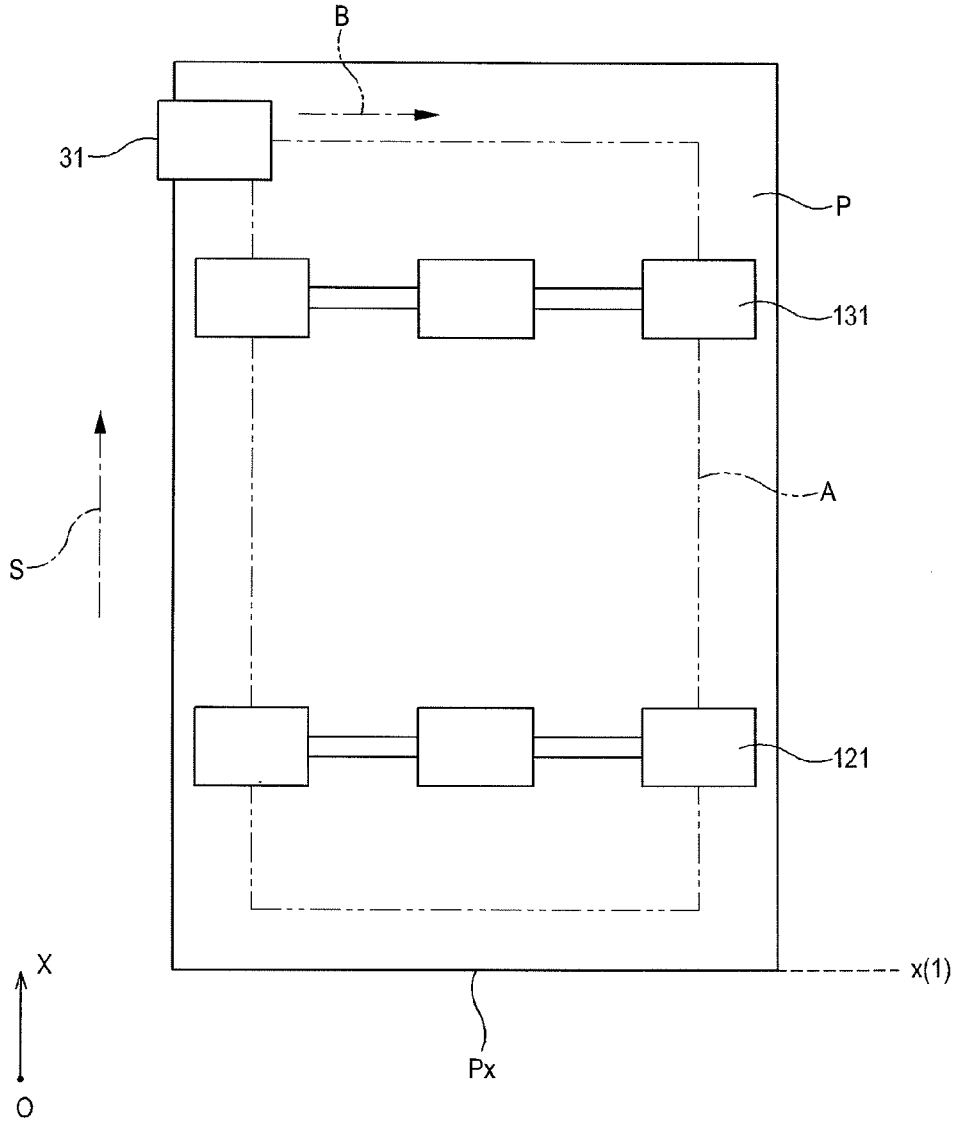
FIG. 7 is a schematic illustration of an internal portion of the ink jet printer in FIG. 3 at respective printing starting points.

As with FIG. 2, the position error e(n) of the $n^{th}$ unit-transfer operation is the difference between the target position X(n) of the $n^{th}$ operation and the actual position (Px) of the trailing edge of the printing medium P. As illustrated in FIG. 7, the target position X(n) may be a value representing a distance from a starting point O in the direction X corresponding to the transferring direction S. A negative position error e(n−1) of $n^{th}$ unit-transfer operation in FIG. 14C, denotes that the trailing edge of the printing medium P has not passed the target position X(n). On the contrary, the positive position error e(n−1) denotes that the trailing edge of the printing medium P has passed the target position X(n) in the transferring direction S.

As illustrated in FIG. 14C, a section M corresponds to an excess-transfer operation in which the printing medium is excess-transferred past the target position X(n) in the unit-transfer operation from the position X(n−1) to the position X(n). Section N corresponds to a retreat-transfer operation in which the printing medium is retreat-transferred in the direction opposite transferring direction S. Also, a section Q corresponds to a forward transfer operation in which the printing medium is forward transferred in the transferring direction S. As illustrated in FIG. 14C, the printing medium can be positioned in the target position X(n) and the position X(n+1), respectively without any error by unit-transferring the printing medium in the external disturbance prevention mode.

Accordingly, the printing medium is positioned in a desired target position to form a line of an ink image, thereby improving an image quality.

Hereinafter, an image forming method of the image forming apparatus will be described by referring to FIG. 15.

First, it is determined whether to transfer the printing medium in the external disturbance prevention mode in a unit-transfer operation (S10). As described above, it may be determined to unit-transfer in the external disturbance prevention mode if the trailing edge of the printing medium is expected to pass through the release position R where the trailing edge of the printing medium is released from its held state by the trailing edge holding unit 120. As another example, if the trailing edge of the printing medium is expected to pass through the release position R in the unit-transfer operation from X(n) to X(n+1), the external disturbance prevention mode can be applied in the unit-transfer operation from X(n−1) to X(n), as necessary.

If the external disturbance prevention mode is applied, the printing medium is excess-transferred in the direction S, that is, the forward direction (S20). Next, the excess-transferred printing medium is retreat-transferred in the direction opposite of the transferring direction S past the target position (S30). Thus, the printing medium is positioned in a position past the target position in the direction opposite the transferring direction S. Then, the retreat-transferred printing medium is transferred to the target position in the forward transferring direction S (S40). It is possible that the operations S20-S40 can be performed according to Section D of FIG. 6.

On the other hand, if it is determined not to apply the external disturbance prevention mode in S10, the printing medium is directly transferred to the target position in the transferring direction S (S50). That is, the printing medium is transferred according to the general mode. It is possible that the operation S50 can be performed according to Section C of FIG. 6.

Also, a line of an image is formed on the printing medium positioned in the target position by the image forming unit (e.g., by image forming unit 30 of FIG. 3) (S60).

The processes of S10 through S60 are repeated until the image forming is completed on one sheet of printing medium (S70).

Meanwhile, if every unit-transfer operation is in accordance with the external disturbance prevention mode, operation S10 may be omitted.

Figure 15:
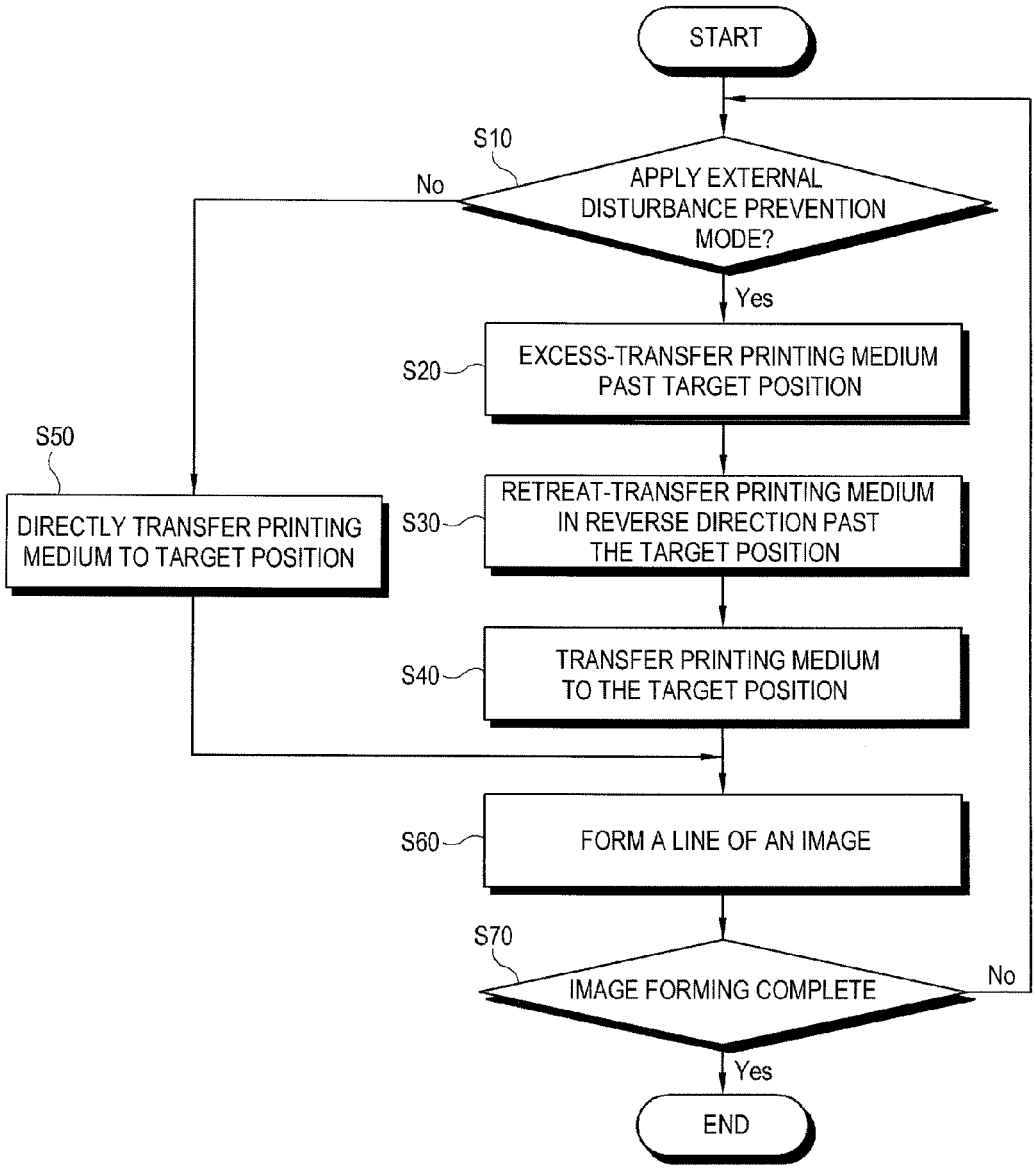
FIG. 15 is a flow chart illustrating an image forming method according to an embodiment of the present general inventive concept.

It will be understood that on or more blocks of the flowchart image forming method of FIG. 15 as well as the operations described above with respect to the other embodiments can be implemented by computer program instructions. These computer program instructions may be recorded in the form of a computer readable medium. The computer readable medium recorded with such computer program instructions can be used for a firmware upgrade of the image forming apparatus. These computer program instructions can be provided to a processor of a general purpose computer, special purpose computer, or other programmable data processing apparatus, such that the instructions, which execute via the processor of the computer or other programmable data processing apparatus, implement the operations specified in the flowchart block or blocks.

It is emphasized that the details of the above described embodiments are exemplary. For example, the present general inventive concept has been described with respect to an ink jet printer. However, the general inventive concept is applicable to other printers and printing devices such as a laser printer.

The embodiments described above may have the following effects.

First, the printing medium can be precisely transferred to a predetermined target position even when an external disturbance occurs.

Second, if the occurrence of the external disturbance is expected, the occurrence of the external disturbance can be prevented by excess-transferring, retreat-transferring, and forward transferring the printing medium in an external disturbance prevention mode.

Third, the printing medium can be again forward-transferred to offset a position error by a backlash generated during a retreat-transfer of the printing medium when a driving force is transmitted from a driving motor to a roller by a gear.

Fourth, the printing medium is unit-transferred to a target position without a position error, thereby improving image quality.

Although a few exemplary embodiments of the present general inventive concept have been illustrated and described, it will be appreciated by those skilled in the art that changes may be made in these embodiments without departing from the principles and spirit of the general inventive concept, the scope of which is defined in the appended claims and their equivalents. As used in this disclosure, the term "preferably" is non-exclusive and means "preferably, but not limited to." Terms in the claims should be given their broadest interpretation consistent with the general inventive concept as set forth in this description. For example, the terms "coupled" and "connect" (and derivations thereof) are used to connote both direct and indirect connections/couplings. As another example, "having" and "including", derivatives thereof and similar transition terms or phrases are used synonymously with "comprising" (i.e., all are considered "open ended" terms)—only the phrases "consisting of" and "consisting essentially of" should be considered as "close ended". Claims are not intended to be interpreted under 112 sixth paragraph unless the phrase "means for" and an associated function appear in a claim and the claim fails to recite sufficient structure to perform such function.

What is claimed is:

1. An image forming apparatus, comprising:

a medium transferring unit which transfers a printing medium to a target position and comprises a trailing edge holding unit which holds a trailing edge part of the printing medium between a pair of rollers; and a controller to determine when the trailing edge part of the printing medium is released from the trailing edge holding unit, and when the controller determines that the trailing edge part of the printing medium is released from the trailing edge holding unit, to control the medium transferring unit to transfer the printing medium in a first direction past the target position and then in a second direction past the target position, and then in the first direction to the target position to form an image on the printing medium at the target position.

2. The image forming apparatus according to claim 1, wherein the medium transferring unit transfers the printing medium intermittently by one step unit to the target position.

3. The image forming apparatus according to claim 1, further comprising:

an image forming unit which forms the image on the printing medium, wherein the controller controls the image forming unit to form an image on the transferred printing medium.

4. The image forming apparatus according to claim 1, wherein:

the medium transferring unit further comprises a leading edge holding unit which holds a leading edge part of the printing medium, wherein the trailing edge holding unit releases a held state of the printing medium when the printing medium reaches a first position, and wherein the controller determines to apply an external disturbance prevention mode when the printing medium passes the first position.

5. The image forming apparatus according to claim 4, wherein the release of the held state by the trailing edge holding unit is accomplished by transferring the printing medium forward in the first direction.

6. The image forming apparatus according to claim 4, wherein the trailing edge holding unit comprises a pair of rollers which rotate to transfer the printing medium forward in the first direction.

7. The image forming apparatus according to claim 4, further comprising:

an encoder which senses a rotation number of one of the leading edge holding unit and the trailing edge holding unit, wherein the controller determines on the basis of the sensed rotation number whether the printing medium passes the release position.

8. An image forming method of an image forming apparatus, the method comprising:

determining when a trailing edge of a printing medium is released from between a pair of rollers of a trailing edge holding unit;

transferring the printing medium in a forward direction past a target position when it is determined that the trailing edge of the printing medium is released from the trailing edge holding unit;

transferring the printing medium in a backward direction past the target position; and transferring the printing medium in the forward direction to the target position to position the printing medium at the target position.

9. The image forming method of claim 8, further comprising:

jetting ink with a printing head, and moving the printing head on a carriage in a transverse direction.

10. The image forming method of claim 8, further comprising:

after positioning the printing medium at the target position, forming an image on the printing medium in the forward direction beginning at the target position.

11. The image forming method of claim 10, comprising:

transferring the printing medium in the forward direction past a next target position which is spaced from the target position in the forward direction;

transferring the printing medium in the backward direction to the next target position; and positioning the printing medium at the next target position.

12. The image forming method of claim 8, wherein the transferring operations and positioning operation occur in an external disturbance mode and the method further comprises determining whether to operate in accordance with the external disturbance prevention mode.

13. The image forming method of claim 12, wherein the medium transferring unit comprises a leading edge holding unit to hold a leading edge part of the printing medium, wherein the trailing edge holding unit releases a held state of the printing medium when the printing medium reaches a first position, and wherein the method further comprises determining to operate in accordance with the external disturbance prevention mode when the printing medium passes the release position.

14. The image forming method of claim 13, wherein the release of the held state by the trailing edge holding unit is accomplished by an excess-transferring stage.

15. The image forming method of claim 13, wherein the trailing edge holding unit comprises a pair of rollers provided to rotate for transferring the printing medium in the forward direction.

16. The image forming method of claim 13, further comprising:

sensing a rotation number of one of the leading edge holding unit and the trailing edge holding unit; and determining whether the printing medium passes the first position on the basis of the sensed result.

17. A computer readable medium storing a program to execute an image forming method of an image forming apparatus, the image forming method comprising:

determining when a trailing edge of a printing medium is released from between a pair of rollers of a trailing edge holding unit;

transferring the printing medium in a forward direction past a target position when it is determined when the trailing edge of the printing medium is released from the trailing edge holding unit;

transferring the printing medium in a backward direction past the target position;

transferring the printing medium in the forward direction to the target position to position the printing medium at the target position.

18. The computer readable medium according to claim 17, wherein the image forming method further comprises, after positioning the printing medium at the target position, moving the printing medium in the forward direction from the target area to form an image on the printing medium.

* * * * *